United States Patent [19]

Tsuchida

[11] 4,106,550

[45] Aug. 15, 1978

[54] PINCH ROLL STAND FOR USE IN MULTI-STRAND CONTINUOUS CASTING MACHINE

[75] Inventor: Yutaka Tsuchida, Yokosuka, Japan

[73] Assignee: Ishikawajima-Harima Jukogyo Kabushiki Kaisha, Ote, Japan

[21] Appl. No.: 762,134

[22] Filed: Jan. 24, 1977

[30] Foreign Application Priority Data

Jan. 27, 1976 [JP] Japan ..... 51-7602

[51] Int. Cl.[2] ..... B22D 11/12

[52] U.S. Cl. ..... 164/448

[58] Field of Search ..... 164/282, 441, 442, 447, 164/448; 308/20; 29/113 R, 113 AD, 116 R, 116 AD, 115; 193/35 R, 37; 72/226; 198/789, 790, 791

[56] References Cited

U.S. PATENT DOCUMENTS 1,437,784 12/1922 Taisey ..... 193/35 R

FOREIGN PATENT DOCUMENTS 213,058 10/1966 Sweden ..... 164/282

*Primary Examiner*—Francis S. Husar
*Assistant Examiner*—John S. Brown
*Attorney, Agent, or Firm*—Scrivener, Parker, Scrivener & Clarke

[57] ABSTRACT

Disclosed is a pinch roll stand for use in a multi-strand continuous casting machine having a plurality of driving multi-pinch-roll assemblies each of which consists of a plurality of pinch rolls coaxially arranged in a hollow part of hollow pinch roll so that the pinch rolls may be driven independently of each other.

5 Claims, 6 Drawing Figures

*Fig. 3*
PRIOR ART
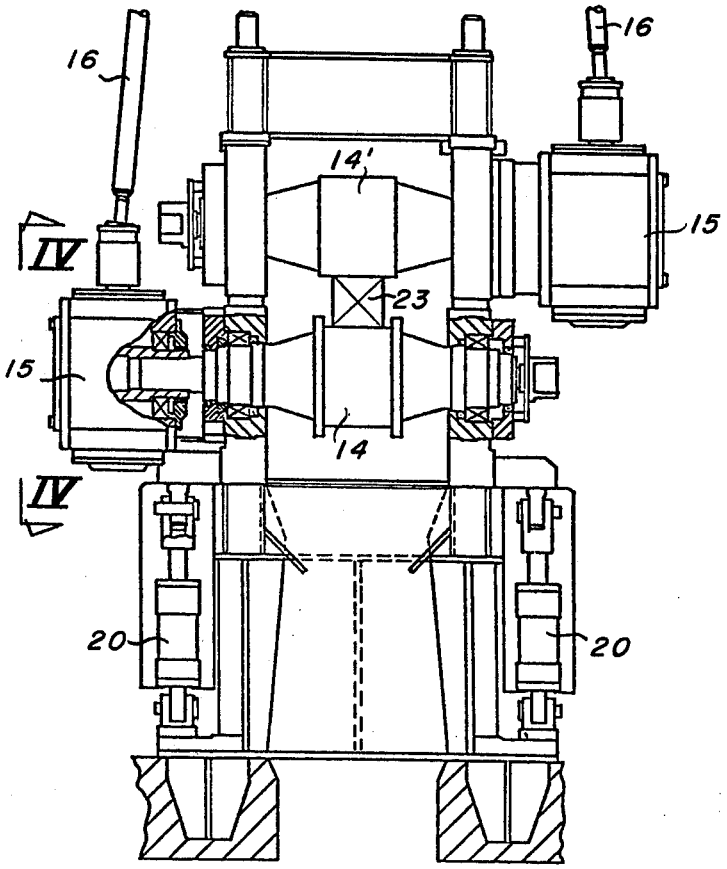
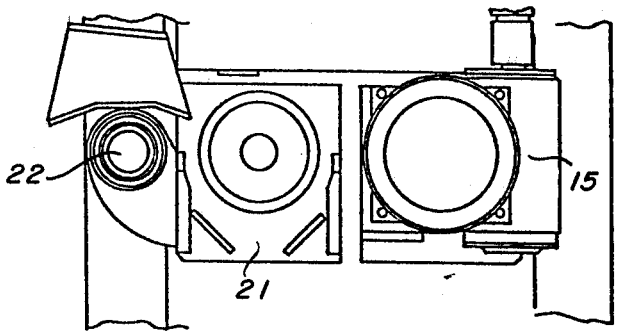
*Fig. 4*
PRIOR ART

PINCH ROLL STAND FOR USE IN MULTI-STRAND CONTINUOUS CASTING MACHINE

DETAILED DESCRIPTION OF THE INVENTION

The present invention relates to a pinch roll apparatus used for drawing semiproducts cast by a multi-strand continuous steel casting machine.

When the continuous casting machines for casting billets, blooms and so on were first introduced, they had only one strand. Since then with the increase in capacity of steel refining furnaces, many attempts have been made in order to increase the capacity of continuous casting machines accordingly. One of them was to increase a casting speed, but the breakout problem imposes a limit to it. Therefore the recent trend has been toward the increase in number of strands in one continuous casting machine in order to increase the production in proportion to the number of strands used. The continuous casting machines with as many as eight strands have long been operating. However, in the prior art multi-strand continuous casting machines, each strand has its own associated devices and equipment including a pinch roll stand so that the reduction in spacing or distance between the adjacent strands has been very difficult. For instance, in an existing continuous casting machine for casting products 120 mm square, the spacing between the adjacent strands is of the order of 1,100 to 1,300 mm. With a wider spacing between the strands, a long tundish must be used so that the distance between the molten steel pouring position and the outermost nozzles is too long to prevent the temperature drop of molten steel below a point at which the nozzle clogging problem occurs. To solve this problem, in the continuous casting machine with six or eight strands, two tundishes have been used, but the maintenance cost is high and maintenance time is long. Furthermore, the nozzle clogging problem has not been essentially solved yet so that the continuous casting machines have been very frequently troubled with the nozzle clogging problem.

Moreover, a multi-strand continuous casting machine with a wider spacing between strands requires a vast installation space with the resultant increase in initial cost.

In order to more specifically point out the above and other problems encountered in the prior art multi-strand continuous steel casting machines, one example will be described with reference to FIGS. 1 through 4. A water-cooled, copper mold 1 is mounted on a mold oscillation table 2 which is operatively coupled through an oscillation lever 3 to a mold oscillation drive generally indicated by 4. A product emerging from the mold 1 is withdrawn through a bending unit 5, a casting bow 6, a straightener 7 and a horizontal table 8 by a pinch roll stand 9 powered with a pinch roll drive 10. At the downstream of the pinch roll stand 9, a shear 11 is moved by a hydraulic or pneumatic cylinder 12 in synchronizm with the product 13 for cutting it into a predetermined length. The cutout products are transferred by a transfer table (not shown) to the next station.

A plurality of strands with the above construction are juxtaposed in order to increase the capacity of the continuous casting machine with the increase in capacity of a steel refining furnace as described above. However, because the pinch roll drive 10 is laterally outwardly set up so that there is a limit to the reduction in spacing between the adjacent strands.

To overcome this problem, as shown in FIGS. 2, 3 and 4 there has been devised and demonstrated a pinch roll stand wherein a pinch roll drive is installed upwardly of pinch rolls and drivingly coupled thereto through a worm gearing. More specifically, a motor 19 is drivingly coupled to pinch rolls 14 and 14' through a worm gearing 18, miter gears 17 and worm gearings 15 so that a product 23 may be withdrawn by the pinch rolls 14 and 14'. As best shown in FIGS. 3 and 4, each bearing block 21 for the lower pinch roll 14 is pivoted with a pin 22 to a pinch roll frame so that upon actuation of a hydraulic or pneumatic cylinder 20 it may be pivoted about the pin 22.

Even with this arrangement, because of the interference between the adjacent reduction gears or worm gearings, bearing blocks and so on there is still a limit to the spacing between the adjacent strands.

There has been also devised and demonstrated a twin-cast type continuous casting machine for casting both slabs and blooms simultaneously. In this machine, only one pair of pinch rolls are used to withdraw both products in two strands and they must withdraw all products in a plurality of strands simultaneously especially when the casting is started. For simultaneously starting the casting in a plurality of strands, molten steel must be poured simultaneously and in the same quantity into a plurality of molds from a tundish so that the operating conditions are very severe.

The present invention was made to overcome the above and other problems encountered in the prior art multi-strand continuous steel casting machines, and has for its object to provide a pinch roll stand or apparatus which serves to reduce considerably the spacing between the adjacent strands.

The above and other objects, features and advantages of the present invention will become apparent from the following description of one preferred embodiment thereof taken in conjunction with the accompanying drawings, in which:

FIG. 3 is a front view, partly in section thereof;

FIG. 4 is a view looking into the direction indicated by the arrows IV of FIG. 3.

Figure 1:
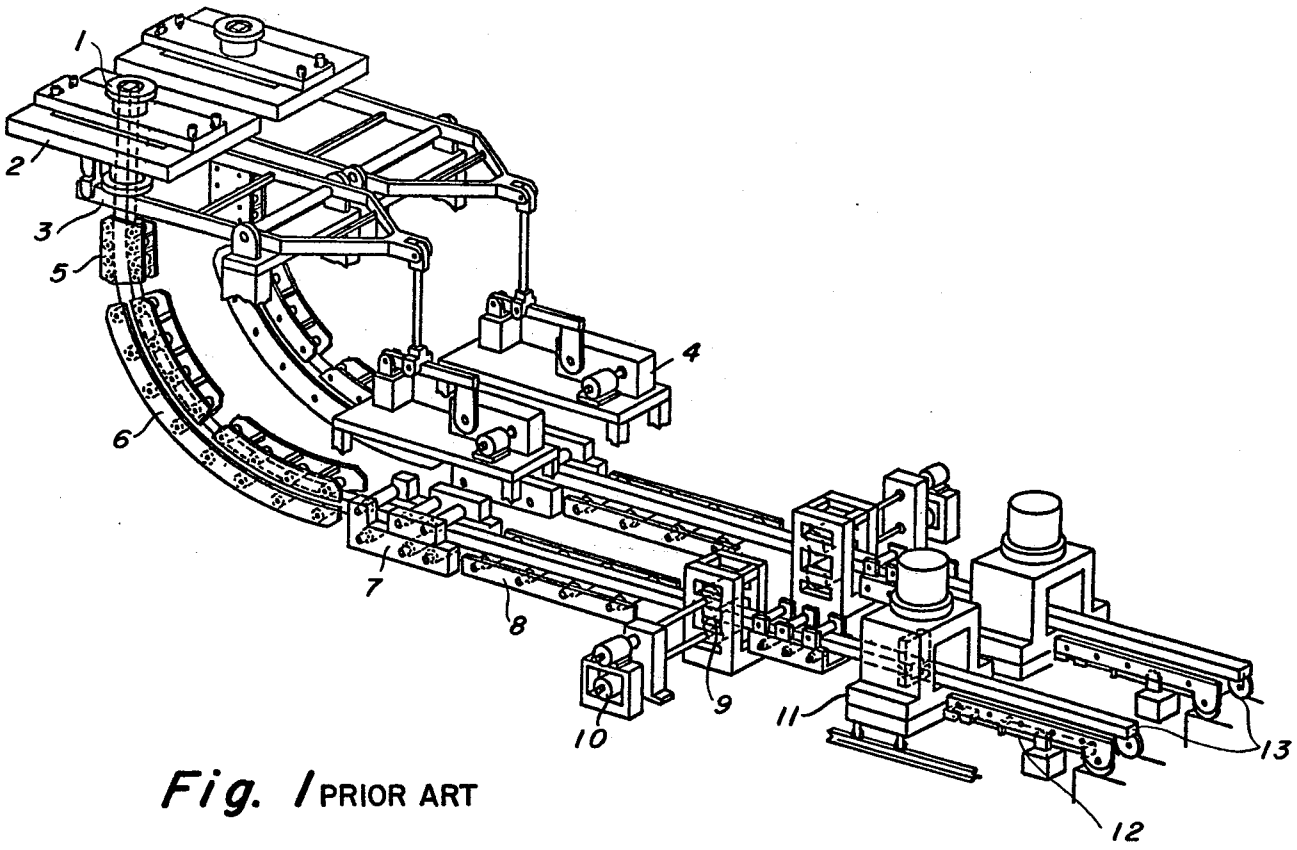
Fig. 1 PRIOR ART
FIG. 1 is a perspective view of a prior art two-strand continuous casting machines, for casting billets and blooms.
Figure 2:
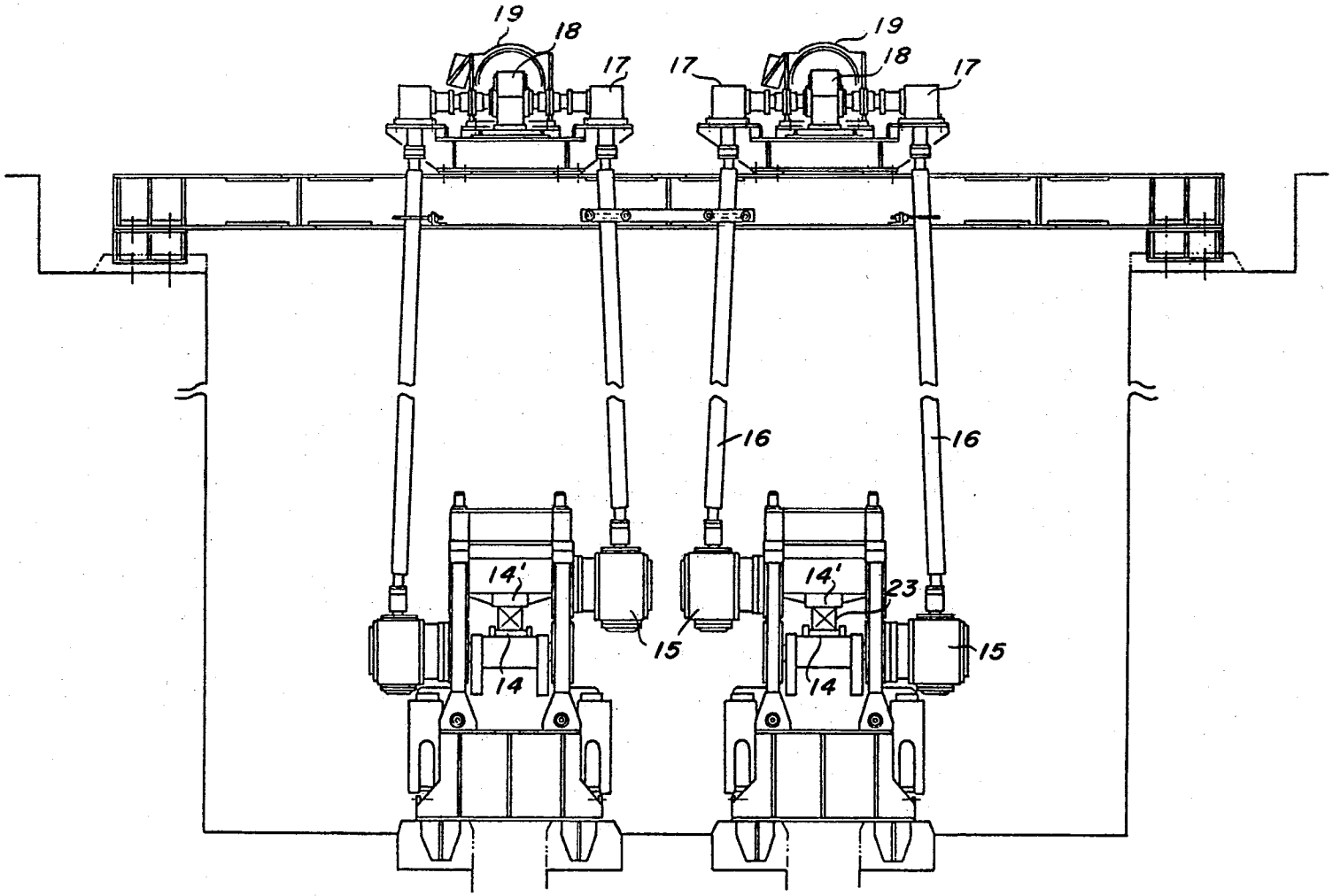
Fig. 2 PRIOR ART
FIG. 2 is a front view of another example of the prior art pinch roll stands used in the line shown in FIG. 1.
Figure 5:
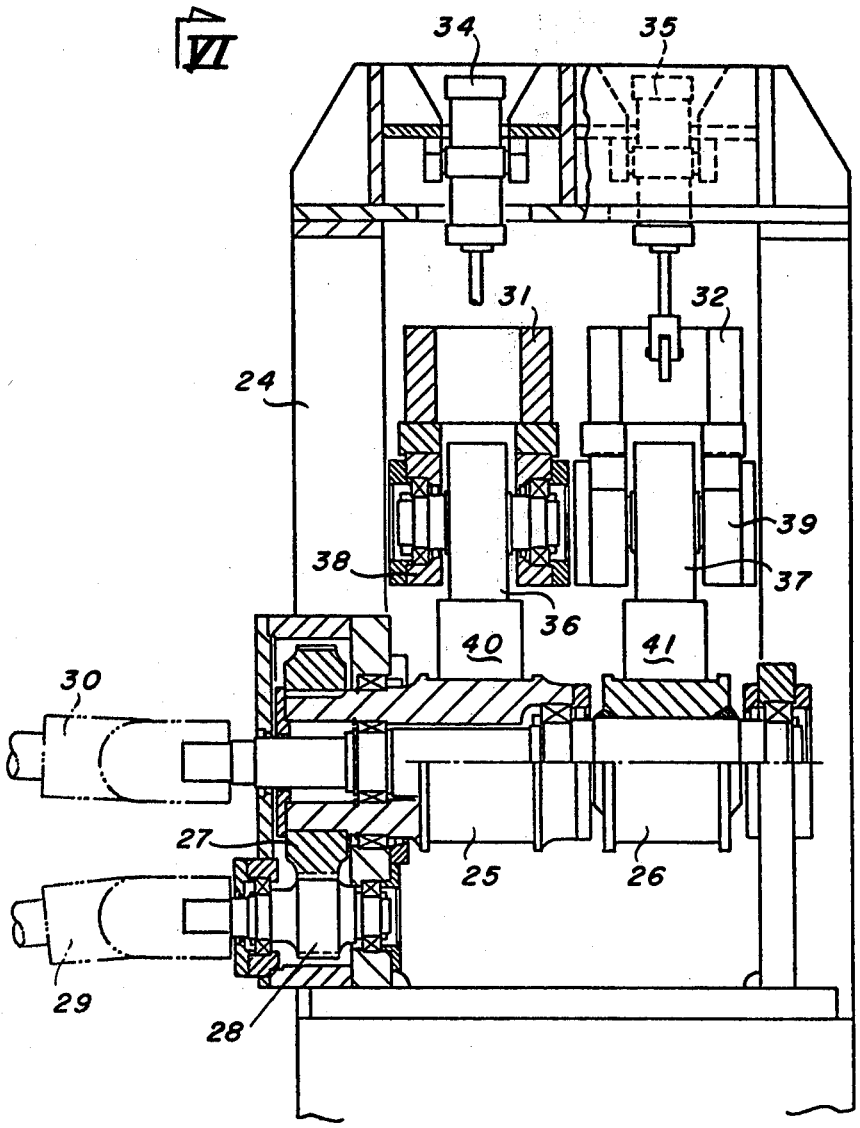
FIG. 5 is a front view, partly in section, of a pinch roll stand in accordance with the present invention for use in a multi-strand continuous casting machines.
Figure 6:
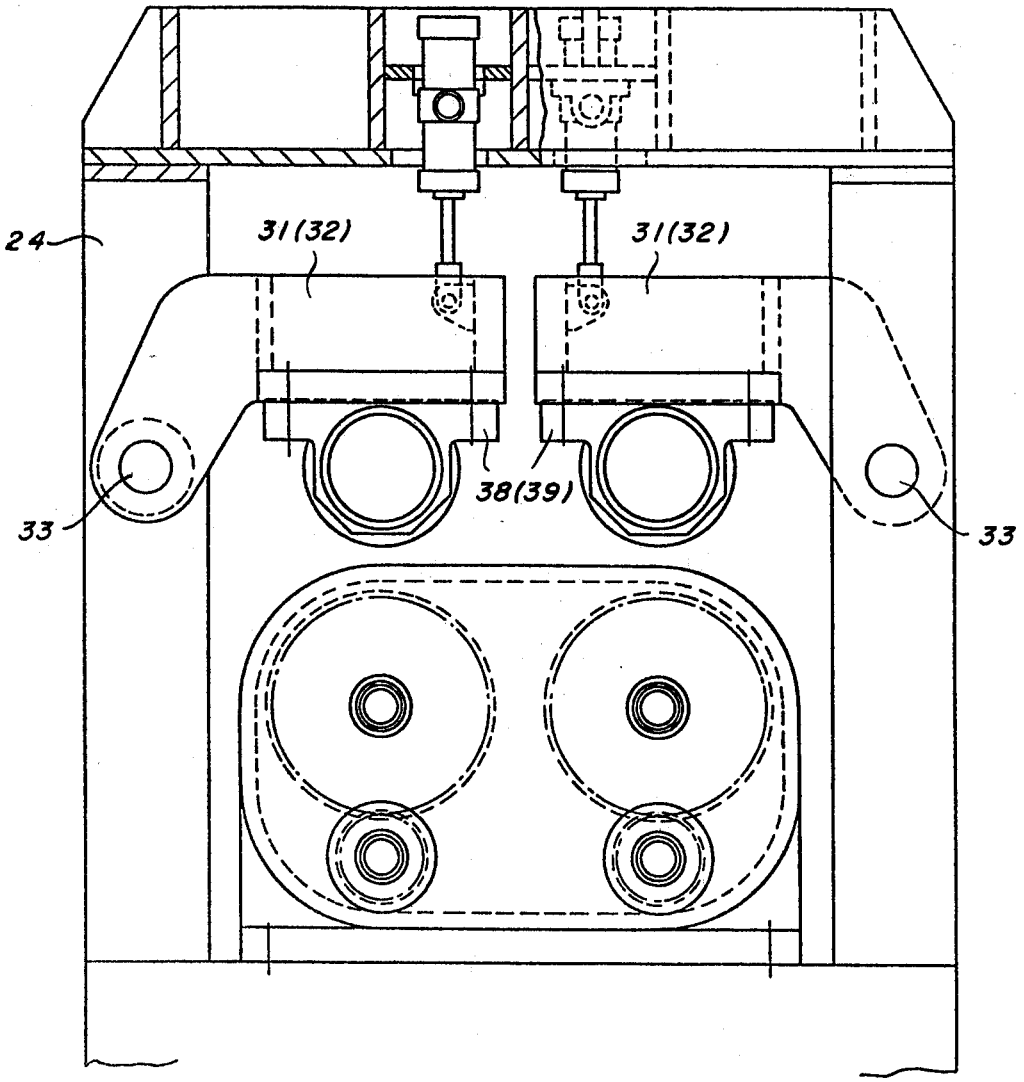
FIG. 6 is a view looking in the direction indicated by the arrow VI of FIG. 5.

Referring to FIGS. 5 and 6, the pinch roll stand in accordance with the present invention includes a plurality of lower pinch roll assemblies each consisting of a hollow pinch roll 25 and a solid pinch roll 26 and a plurality of upper pinch rolls 36 and 37. The right pinch roll 26 has its one (right in FIG. 5) bearing neck rotatably supported with a roll bearing which in turn is securely supported on a pinch roll stand frame 24 and its the other bearing neck extended through the left hollow pinch roll 25 coaxially thereof with roll bearings interposed therebetween in such a way that the other bearing neck of the pinch roll 26 and the hollow pinch roll 25 may freely rotate with respect to each other. A left bearing neck of the hollow pinch roll 25 is rotatably supported with a roll bearing which in turn is securely mounted on the frame 24. A gear 27 which is supported at the free end of the left bearing neck of the hollow pinch roll 25 is in mesh with a pinion 28 which is rotatably supported in the frame 24 and is drivingly coupled through a universal shaft 29 to a pinch roll drive (not shown). The left end of the left bearing neck of the pinch roll 26 is extended beyond the left end of the bearing neck of the pinch roll 25 and is drivingly coupled through a universal shaft 30 to a pinch roll drive (not shown). Thus respective pinch rolls 25 and 26 of the lower pinch roll assembly arranged horizontal between the frames 24 may be driven individually independent of each other by respective drive (not shown).

The upper pinch rolls 36 and 37 are substantially similar in construction so that the description of only one of them will suffice. A bearing arm 31 with roll bearings for supporting the necks of the upper pinch roll 36 is pivoted with a pin 33 to the frame 24 at a suitable height from the foundation. A hydraulic or pneumatic cylinder 34 is vertically securely mounted on a horizontal top grinder of the pinch roll stand and has its piston rod pivotably connected to one end of the bearing arm 31 remote from the pin 33 so that upon actuation of the power cylinder 34 the upper pinch roll 36 which is rotatably supported with the roll bearings 38 may be moved toward or away from a product 40 being withdrawn. That is, the pressure exerted to the product 40 in cooperation with the lower pinch roll 25 may be suitably adjusted.

As described above, according to the present invention employed in the pinch roll stand are plurality of lower double-pinch-roll assemblies each consisting of the hollow pinch roll 25 and the pinch roll 26 having its one bearing neck rotatably and coaxially extended through the hollow pinch roll 25 so that the spacing between the adjacent strands may be reduced to such an extent that the adjacent products 40 and 41 are almost made into contact with each other as shown in FIG. 5. More specifically, the spacing may be reduced to ¼ to 1/5 as compared with the prior art multi-strand continuous casting machines.

So far the present invention has been described as applied to the double-pinch-roll assembly, but it will be understood that it will be equally applied to a triple- and multi-pinch-roll assembly. In addition, the pinch roll stand of the present invention may be employed not only in the vertical and curved guidance continuous casting machines but also in the horizontal multi-strand continuous casting machines. Furthermore various modifications may be effected without departing from the true spirit of the present invention.

The pinch roll stand in accordance with the present invention for use in a multi-strand continuous casting machine has the following features and advantages:

(1) Since the spacing between the adjacent strands may be considerably reduced as compared with the prior art stands, an installation space for a multi-strand continuous casting machine may be reduced with the resultant decrease in initial cost.

(2) Since the spacing between the adjacent strands is reduced, a tundish with a shorter length may be used. Even with a continuous casting machine with six to eight strands, the use of a plurality of tundishes is not necessary. Thus, the nozzle clogging problem may be substantially eliminated.

(3) Since a small-sized tundish may be used, the running cost such as the cost for replacement of refractories may be considerably reduced.

(4) As compared with the prior art twin or triple continuous casting machines, each pinch roll is driven independently of the others so that the starting of casting in each strand may be adjusted independently of the other strands and consequently the operating conditions may be much improved; that is, the difficulties encountered in the operation of the prior art multi-strand continuous casting machine may be substantially eliminated.

(5) Whereas in the prior art multi-strand continuous casting machines, similar parts must be prepared in number in proportion to the number of strands, the pinch rolls in accordance with the present invention may be built into a very compact unitary assembly so that required parts may be considerably reduced in number.

(6) The pinch roll stand in accordance with the present invention is very simple in construction and assembly yet very robust.

I claim:

1. A pinch roll stand for use in a multi-strand continuous casting machine, comprising a plurity of pinch-roll assemblies supported in said stand, each assembly comprising a first hollow pinch roll and a second pinch roll having a bearing neck rotatably extending through said hollow pinch roll coaxially thereof, and means for driving said first and second pinch rolls in each assembly individually and independently of each other.

2. A pinch roll stand as set forth in claim 1, wherein another pinch roll is provided for each of the pinch rolls of said assemblies, said another pinch roll being carried by a bearing arm which is pivotably in a vertical plane so that said pinch roll may be moved toward or away from its corresponding pinch roll.

3. A pinch roll stand as set forth in claim 1 wherein the bearing necks of said first and second the outermost pinch rolls of each assembly are rotatably supported by said pinch-roll-stand.

4. A pinch roll stand as set forth in claim 1 wherein a pinch roll driving device is drivingly coupled to each bearing neck of the pinch roll and extends laterally beyond the outer bearing neck of the pinch roll at one of the outermost sides of each assembly.

5. A pinch roll stand for use in a multi-strand continuous casting machine comprising a hollow pinch roll rotatably supported in said stand, and a second pinch roll coaxially arranged with said hollow pinch roll, said pinch rolls forming a multi-pinch-roll assembly, each of said pinch rolls having a bearing neck rotatably supported by said stand, and a rotatable bearing neck of said second pinch roll extending laterally within said hollow pinch roll, and means for separately driving the pinch rolls of said assembly so that the pinch rolls may be driven independently of each other.

* * * * *